US005427677A

United States Patent [19]

Mosher

[11] Patent Number: 5,427,677

[45] Date of Patent: Jun. 27, 1995

[54] FLUX FOR REFLOWING TINPLATE

[75] Inventor: Claudia Mosher, Amityville, N.Y.

[73] Assignee: LeaRonal, Inc., Freeport, N.Y.

[21] Appl. No.: 198,913

[22] Filed: Feb. 18, 1994

[51] Int. Cl.[6] ..... C25D 5/52

[52] U.S. Cl. ..... 205/138; 205/140; 205/152; 205/154; 205/196; 205/226

[58] Field of Search ..... 205/138, 139, 140, 152, 205/153, 154, 226, 196

[56] References Cited

U.S. PATENT DOCUMENTS

| | | | |
|---|---|---|---|
| 2,633,450 | 3/1953 | Andrews | 205/226 |
| 3,860,502 | 1/1975 | Johnson | 204/54 R |
| 4,052,234 | 10/1977 | Yamagishi et al. | 205/138 |
| 5,174,887 | 12/1992 | Federman et al. | 205/253 |

FOREIGN PATENT DOCUMENTS 133835 11/1977 Japan .

OTHER PUBLICATIONS

Belousova et al. Improving the practice of fluxing and hardening strip in an electrolytic tinning line, *Stal* (USSR) , May 1991.

"A History of Tinplate" by Smith, Tin International, Jun. 1978.

"The Technology of Tinplate" by Hoare et al., St. Martin's Press, New York, 1965.(no month).

*Primary Examiner*—John Niebling
*Assistant Examiner*—Edna Wong
*Attorney, Agent, or Firm*—Pennie & Edmonds

[57] ABSTRACT

An improved process for reflowing tinplate by treating a matte finish of tinplate with a flux, and reflowing the fluxed matte tinplate to produce bright tinplate, wherein the flux is a naphthalenesulfonic compound, preferably having the a naphthalene ring which is substituted with at least one —$SO_3M$ group where M is hydrogen, an alkali metal or an alkaline earth metal and is optionally substituted with at least one hydroxy group. The flux is preferably applied to the matte tinplate in an aqueous solution which may contain an acid. The most preferred fluxes are 2-naphthol-6,8-disulfonic acid, 1-naphthol-3,6-disulfonic acid, and dipotassium 2-naphthol-6,8-disulfonate.

24 Claims, No Drawings

FLUX FOR REFLOWING TINPLATE

FIELD OF THE INVENTION

This invention relates to a method for improving the finish of tinplate which has been produced by electroplating tin onto steel strip. Specifically, the invention relates to a new material which can be used as a flux to assist in the reflowing of the tinplate.

BACKGROUND OF THE INVENTION

The electrolytic tinning of steel strip to produce a material referred to as "tinplate" is well known in the art. The process is described in detail in the book "The Technology of Tinplate" by Hoare et al., published by St. Martin's Press, New York, 1965.

Strip steel is electroplated with tin in large continuous plating machines at steel mills throughout the world. In these machines, a large coil of steel sheet unwinds at one end of the machine and proceeds through cleaning and acid pickling stations, followed by multiple tin electroplating stations to produce a tin deposit over the steel surface. The tin coating, as plated, exhibits a characteristic smooth matte surface.

The next major section of the line is variously known as the "flow-melting", "flow-brightening", or "reflow" section. The reflow operation is used to transform the matte deposit to the bright reflective finish typical of tinplate and to produce a thin iron-tin compound layer at the interface between the tin coating and the steel base, thereby improving corrosion resistance. The operation includes the steps of raising the temperature of the tin coating to above the melting point of tin, followed by immediate quenching to impart and achieve the desired properties of the deposit.

In the reflow operation, after the matte tinplate is rinsed, the steel sheet proceeds through a fluxing station. The term "flux" in this context refers to a substance that aids, induces, or otherwise actively participates in fusing or flowing. The application of flux is followed by the reflow station itself which raises the temperature of the steel to slightly above the melting point of tin. The steel is then quickly quenched in water, resulting in a tin surface that has a bright finish. After reflow, the steel proceeds through other stations for treatments such as passivation, oiling, and rewinding or cutting into sections at the exit-end of the machine.

A uniform, bright finish is achieved without blemishes or discontinuities if all of the above steps are carried out to perfection. A flux treatment prior to reflow is important to prevent formation of tin oxides or hydroxides in the reflow process which would otherwise cause defects in the tin finish during reflow. The most serious defect that is generally encountered is referred to as "woodgrain". Woodgrain is a defect in reflowed tinplate in which the surface takes on the non-uniform appearance of polished wood. Other common defects are a blue haze effect and white staining.

Prior art fluxes are all acidic in nature and consist of an aqueous solution of an acid such as hydrochloric acid or phenolsulfonic acid or of an acid salt such as ammonium chloride or zinc chloride. This type of flux treatment was developed in 1957 and was described in "A History of Tinplate" by Dr. Anthony Smith published in *Tin International*, March 1977 to June 1978.

Belousova et al. in Stal (USSR), May 1991, describe the use of phenolsulfonic acid in a fluxing solution. Tinplate was obtained from a phenolsulfonic acid-based solution that contained naphthoxol-7S as an additive to achieve fine grained tin deposits. However, phenolsulfonic acids are pollutants which cannot be discharged into the environment.

Accordingly, there remains a need for improved fluxes which can achieve the desired properties of the reflowed tinplate while at the same time not utilizing chemicals which present disposal and pollution problems.

SUMMARY OF THE INVENTION

This invention discloses a new class of flux materials that may be used as a predip prior to reflowing tin deposits on strip steel. The present invention relates to the flux treatment and provides an improved flux that helps to achieve the desired uniform bright tin finish. The flux materials according to the present invention—which are generally classified as naphthalenesulfonic compounds—are non-poisonous and environmentally friendly.

One embodiment of the invention specifically relates to a method for producing bright tinplate which comprises contacting matte tinplate with an aqueous solution of a naphthalenesulfonic compound to provide a coating of said compound thereon, heating the coated matte tinplate to a temperature above the melting point of tin but below the melting point of steel, and quenching the heated coated matte tinplate to provide bright tin deposit thereon.

In another embodiment, the invention relates to a process that includes the steps of electrolytically plating steel strip with a matte finish of tin, treating the matte tin with a flux, and reflowing the fluxed matte tin to produce a bright tin deposit. The improvement in this process relates to the use of a flux of a naphthalenesulfonic compound.

For either embodiment, the naphthalenesulfonic compound advantageously has a naphthalene ring which is substituted with at least one $—SO_3M$ group where M is hydrogen, an alkali metal or an alkaline earth metal, and which is optionally substituted with at least one hydroxy group. Preferably, the flux is applied to the steel in an aqueous solution which optionally contains an acid therein, with the concentration of the naphthalenesulfonic compound in the aqueous solution being from about 0.5 g/l to saturation and preferably from about 5 to 20 g/l.

DETAILED DESCRIPTION OF THE INVENTION

It has been discovered that aqueous solutions of naphthalenesulfonic acids and of hydroxynaphthalenesulfonic acids, and of alkali metal salts of such acids, make a superior flux for tinplate prior to reflow. Accordingly, in its broadest aspect, the present invention contemplates a method for producing bright tinplate which comprises immersing matte tinplate into an aqueous solution of a naphthalene-sulfonic acid or salt thereof, removing and drying the matte tinplate from the aqueous solution in order to provide matte tinplate that is coated with the naphthalenesulfonic acid or salt thereof, heating the coated matte tinplate to a temperature above the melting point of tin but below the melting point of steel, and quenching the heated coated matte tinplate to provide bright tinplate. Another aspect of the present invention is a composition of matter suitable for applying a flux to electrolytically-produced matte tinplate that comprises a solution of from 5 to 20 g/l of a naphthalenesulfonic acid or salt thereof in an aqueous medium.

Naphthalenesulfonic acids as a class are known as chemical precursors for dye intermediates, wetting agents and dispersants, naphthols, and air-entrainment agents for concrete. Generally, the sulfonation of naphthalene leads to a mixture of products. Naphthalene sulfonation at less than 100° C. produces predominantly 1-naphthalenesulfonic acid. Sulfonation of naphthalene at above 150° C. provides 2-naphthalene-sulfonic acid as the main product. In naphthalene polysulfonation, a staged program of acid addition or control of acid concentration and time-temperature parameters often is used to obtain a desired product mix. It is contemplated by the present invention that any of these products can be used.

Specific naphthalenesulfonic acids that may be used in accordance with the present invention include 1-naphthalenesulfonic acid, 2-naphthalenesulfonic acid, 1,5-naphthalenedisulfonic acid, 1,6-naphthalenedisulfonic acid, 2,6-naphthalene-disulfonic acid, 2,7-naphthalenedisulfonic acid, 1,3,5-naphthalenetrisulfonic acid, and 1,3,6-naphthalenetrisulfonic acid.

Hydroxynaphthalenesulfonic acids as a class are known as intermediates either for coupling components for azo dyes or azo components and for synthetic tanning agents. Hydroxynaphthalenesulfonic acids can be manufactured either by sulfonation of naphthols or hydroxynaphthalenesulfonic acids, by acid hydrolysis of aminonaphthalenesulfonic acids, by fusion of sodium naphthalenepolysulfonates with sodium hydroxide, or by desulfonation or rearrangement of hydroxynaphthalenesulfonic acids. Any of these compounds are also believed to be useful according to the present invention.

Specific hydroxynaphthalenesulfonic acids that may be used in the present invention include 4-hydroxy-2-naphthalenesulfonic acid, 4-hydroxy-1-naphthalenesulfonic acid, 5-hydroxy-1-naphthalenesulfonic acid, 8-hydroxy-1-naphthalenesulfonic acid, 2-hydroxy-1-naphthalenesulfonic acid, 6-hydroxy-2-naphthalenesulfonic acid, 7-hydroxy-2-naphthalenesulfonic acid, 7-hydroxy-1-naphthalenesulfonic acid, 4,5-dihydroxy-1-naphthalenesulfonic acid, 6,7-dihydroxy-1-naphthalenesulfonic acid, 5-hydroxy-2,7-naphthalenedisulfonic acid, 8-hydroxy-1,6-naphthalenedisulfonic acid, 4-hydroxy-1,6-naphthalenedisulfonic acid, 4-hydroxy-1,5-naphthalenedisulfonic acid, 3-hydroxy-2,7-naphthalenedisulfonic acid, 7-hydroxy-1,3-naphthalenedisulfonic acid, 4,5-dihydroxy-2,7-naphthalenedisulfonic acid, 8-hydroxy-1,3,6-naphthalenetrisulfonic acid, and 7-hydroxy-1,3,6-naphthalenesulfonic acid.

Also contemplated are alkali metal salts of such acids, for instance, sodium 3-hydroxy-2,7-naphthalenedisulfonate. Thus, the term naphthalenesulfonic compound is used to generally designate all compounds mentioned above including these acids, their salts and hydroxy containing derivatives thereof.

Currently, the most preferred compounds for use as fluxes are 7-hydroxy-1,3-naphthalenedisulfonic acid (2-naphthol-6,8-disulfonic acid), 5-hydroxy-2,7-naphthalenedisulfonic acid (1-naphthol-3,6-disulfonic acid), and potassium 7-hydroxy-1,3-naphthalenedisulfonate (the dipotassium salt of 7-hydroxy-1,3-naphthalenedisulfonic acid).

Structural formulas for various naphthalenesulfonic acids that may be used in accordance with the present invention are depicted below:

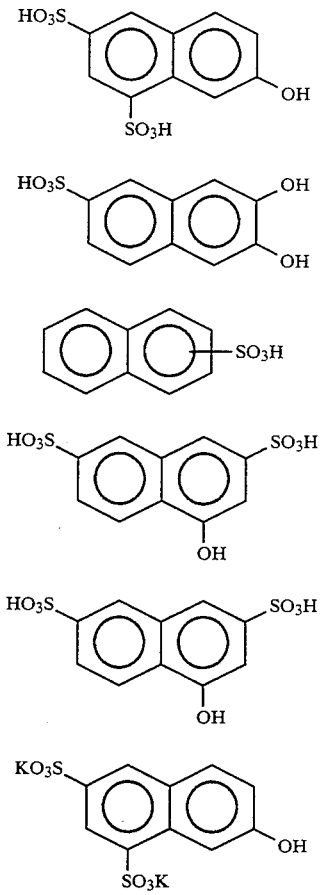

The concentrations of these compounds in water are approximately 0.5 g/l to saturation and most preferably 5 to 20 g/l. The temperature of the fluxing solution is advantageously maintained in the range of approximately 65° to 200° F. and preferably between about 150° and 160° F.

The fluxing solution may or may not be acidic in nature. If an acid is desirable, any conventional acids or acid salts can be added to the flux solution including hydrochloric acid, sulfuric acid, citric acid, alkane sulfonic acids such as methanesulfonic acid, alkanol sulfonic acids, ammonium chloride, and the like.

EXAMPLES

The performance of various compounds as fluxes was evaluated by electroplating 50 micro inches of tin onto properly prepared steel strip, applying the flux to the surface, then reflowing the tin. Details of this procedure are found in the following table:

| A Steel Panel Was Treated As Follows: | | |
|---|---|---|
| 1. Alkaline Cleaner | 130° F. | 1 minute |
| 2. Rinse | RT | 10 sec. |
| 3. Rinse | RT | 10 sec. |
| 4. Pickle (5–10% $H_2SO_4$) | RT | 5 sec. |
| 5. Rinse | RT | 10 sec. |
| 6. Tinplate (50 micro inches) | 105° F. | 100 ASF |
| 7. Rinse | RT | 10 sec. |
| 8. Rinse | RT | 10 sec. |
| 9. Flux (to be tested) | 150–160° F. | 10 sec. |
| 10. Dry | | |
| 11. Reflow | | 16 sec. |
| 12. Quench | 150° F. | |

-continued

| A Steel Panel Was Treated As Follows: | | |
|---|---|---|
| 13. Chromate | 140° F. | 3 sec. |
| 14. Rinse | RT | 10 sec. |
| 15. Rinse | RT | 10 sec. |
| 16. Dry (Pressurized Air Stream) | RT | 10 sec. |

Examples 1–6

A steel strip was plated in a commercial pure tin plating process to a thickness of 50 micro inches. The plated panel was then immersed in a fluxing solution prior to being flow melted using an AC resistance to raise the panel temperature above the tin melting point, and then quenched and chromated. The fluxing solution contained the material to be tested in water at a concentration of 0.05M. Comparative samples are designated by letters. The temperature of the fluxing stage was 160° F. After chromating, the surface finish of the panel was evaluated. Results were as follows:

| Comparative Samples | | |
|---|---|---|
| Sample | Flux | Results |
| A | none | Large areas of woodgrain and blue haze |
| B | hydrochloric acid | Bright with some blue haze |
| C | phenolsulfonic acid | Fully bright and uniform |

| The Invention | | |
|---|---|---|
| Example | Flux | Results |
| 1 | 2-Naphthol-6,8-Disulfonic Acid | Fully bright and uniform |
| 2 | 2,3-Dihydroxynaphthalene-6 Sulfonic Acid | Bright with some blue haze |
| 3 | Naphthalenesulfonic Acid (Leukanol from Rohm and Haas) | Bright with some white stains |
| 4 | 1-Naphthol-3,6-Disulfonic acid | Fully bright and uniform |
| 5 | 2-Naphthol-3,6-Disulfonic acid | Bright with slight woodgrain |
| 6 | Dipotassium 2-Naphthol-6,8-Disulfonate | Fully bright and uniform. |

Although phenolsulfonic acid (Comparative Example C) resulted in a fully bright and uniform finish, it must be noted that this sample was made from freshly prepared and uncontaminated phenolsulfonic acid. Also, this acid is considered to be hazardous and unfriendly to the environment. In comparison, the naphthalenesulfonic acids are considered to be non-poisonous and environmentally friendly.

Examples 7–11

A steel strip was plated in a commercial pure tin plating process to a thickness of 50 micro-inches. The plating process utilized an electrolye which was based on methane sulfonic acid. The plated panel was then immersed in a fluxing solution prior to being flow melted using an AC resistance to raise the panel temperature above the tin melting point, and then quenched and chromated.

The fluxing solution contained the material to be tested in water to which had been added 20 ml per liter methane sulfonic acid. This acid was added to simulate commercial operating conditions, since small amounts of methane sulfonic acid will often be present in the fluxing solution due to dragout or other contamination from the electroplating process. The material to be tested was present at a concentration of 0.05M and the temperature of the fluxing stage was 160° F. After chromating, the surface finish of the panel was evaluated. Results were as follows:

| Comparative Samples | | |
|---|---|---|
| Sample | Flux | Results |
| D | hydrochloric acid | not satisfactory |
| E | phenolsulfonic acid | not satisfactory |

For Comparative Samples D and E, the surface was not uniformly bright and had a number of hazy areas.

| The Invention | | |
|---|---|---|
| Example | Flux | Results |
| 7 | 2-Naphthol-6,8-Disulfonic Acid | Fully bright and uniform |
| 8 | 2,3-Dihydroxynaphthalene-6 Sulfonic Acid | Bright with some blue haze |
| 9 | Naphthalenesulfonic Acid (Leukanol from Rohm and Haas) | Bright with some white stains |
| 10 | 1-Naphthol-3,6-Disulfonic Acid | Uniform, Not fully bright |
| 11 | 2-Naphthol-3,6-Disulfonic Acid | Bright with slight woodgrain |

From the results it is seen that phenolsulfonic acid and hydrochloric acid are unacceptable when small amounts of methanesulfonic acid is present as a contaminant. Therefore, these acids are unsuitable as fluxes for commercial installations because this and other contamination will be present. The naphthalene sulfonates of the present invention provide unexpectedly superior performance in this situation.

Examples 12–13

To further simulate commercial production conditions, tests were carried out using tin plated steel panels as in the previous examples. The fluxing solution of comparative Example 12 was contaminated with a commercial tin plating solution that contained methane sulfonic acid, divalent tin and typical addition agents. This fluxing solution was a 5% aqueous solution of the plating bath. The flow-melted panel resulting from the use of this solution exhibited stains and hazy, non-uniform areas.

In Example 13, another test was performed using the fluxing solution of Example 12 to which 0.05M of 2-naphthol 6,8-disulfonic acid was added. The flow-melted panel was found to be uniformly bright.

The description of the invention sets forth the underlying discovery that environmentally innocuous naphthalenesulfonic acids and their salts may be used as a flux in the production of bright tinplate. It should be understood that the invention is not limited to the above-recited embodiments, and that changes or modifications may be made by one of ordinary skill in the art. Specifically, the skilled artisan could modify the naphthenic compounds of the invention by adding groups to increase the solubility of these compounds in aqueous solutions. It is contemplated that all modifications which do not depart from the spirit of the invention are within the scope of the appended claims.

What is claimed is:

1. A method for producing bright tinplate which comprises contacting matte tinplate with an aqueous flux solution of a naphthalenesulfonic compound to provide a coating of said compound thereon, heating the coated matte tinplate to a temperature above the melting point of tin but below the melting point of steel, and quenching the heated coated matte tinplate to provide bright tinplate thereon.

2. A method as in claim 1 wherein the concentration of the naphthalenesulfonic compound in the aqueous solution is at least about 0.5 g/l.

3. A method as in claim 1 wherein the concentration of the naphthalenesulfonic compound in the aqueous solution is from 5 to 20 g/l.

4. A method as in claim 1 wherein said naphthalenesulfonic compound has a naphthalene ring which is substituted with at least one —$SO_3M$ group where M is hydrogen, an alkali metal or an alkaline earth metal.

5. A method as in claim 4 wherein the naphthalenesulfonic compound is 1-naphthalenesulfonic acid, 2-naphthalenesulfonic acid, 1,5-naphthalenedisulfonic acid, 1,6-naphthalenedisulfonic acid, 2,6-naphthalenedisulfonic acid, 2,7-naphthalenedisulfonic acid, 1,3,5-naphthalenetrisulfonic acid, or 1,3,6-naphthalenetrisulfonic acid.

6. A method as in claim 4 wherein the naphthalenesulfonic compound is substituted with at least one hydroxy group.

7. A method as in claim 6 wherein the naphthalenesulfonic compound is 4-hydroxy-2-naphthalenesulfonic acid, 4-hydroxy-1-naphthalenesulfonic acid, 5-hydroxy-1-naphthalenesulfonic acid, 8-hydroxy-1-naphthalenesulfonic acid, 2-hydroxy-1-napthalenesulfonic acis, 6-hydroxy-2-naphthalenesulfonic acid, 7-hydroxy-2-naphthalenesulfonic acid, 7-hydroxy-1-naphthalenesulfonic acid, 4,5-dihydroxy-1-naphthalenesulfonic acid, 6,7-dihydroxy-1-naphthalenesulfonic acid, 5-hydroxy-2,7-naphthalenedisulfonic acid, 8-hydroxy-1,6-naphthalenedisulfonic acid, 4-hydroxy-1,6-naphthalenedisulfonic acid, 4-hydroxy-1,5-naphthalenedisulfonic acid, 3-hydroxy-2,7-naphthalenedisulfonic acid, 7-hydroxy-1,3-naphthalenedisulfonic acid, 4,5-dihydroxy-2,7-naphthalenedisulfonic acid, 8-hydroxy-1,3,6-naphthalenetrisulfonic acid, or 7-hydroxy-1,3,6-naphthalenetrisulfonic acid.

8. A method as in claim 6 wherein the naphthalenesulfonic compound is 2-naphthol-6,8-disulfonic acid, 1-naphthol-3,6-disulfonic acid, or dipotassium 2-naphthol-6,8-disulfonate.

9. A method as in claim 1 wherein said flux solution is heated to a temperature of about 160° F.

10. A method as in claim 1 which further comprises adding an acid component to the solution.

11. A method as in claim 10 wherein the acid component is hydrochloric acid, sulfuric acid, citric acid, an alkane sulfonic acid, an alkanol sulfonic acid, or ammonium chloride.

12. A method as in claim 1 which further comprises providing the matte tinplate by electrolytically plating steel strip with a matte finish of tin, and wherein the refluxed matte tin is heated and quenched as part of a reflowing operation to produce the bright tin deposit.

13. A method of claim 12 wherein the concentration of the naphthalenesulfonic compound in the aqueous solution is at least about 0.5 g/l.

14. A method of claim 12 wherein the concentration of the naphthalenesulfonic compound in the aqueous solution is from 5 to 20 g/l.

15. A method of claim 12 wherein the naphthalenesulfonic compound has a naphthalene ring which is substituted with at least one —$SO_3M$ group where M is hydrogen, an alkali metal or an alkaline earth metal.

16. A method of claim 15 wherein the naphthalenesulfonic compound is 1-naphthalenesulfonic acid, 2-naphthalenesulfonic acid, 1,5-naphthalenedisulfonic acid, 1,6-naphthalenedisulfonic acid, 2,6-naphthalenedisulfonic acid, 2,7-naphthalenedisulfonic acid, 1,3,5-naphthalenetrisulfonic acid, or 1,3,6-naphthalenetrisulfonic acid.

17. A method of claim 15 wherein the naphthalenesulfonic compound is substituted with at least one hydroxy group.

18. A method of claim 15 wherein the naphthalenesulfonic compound is 4-hydroxy-2-naphthalenesulfonic acid, 4-hydroxy-1-naphthalenesulfonic acid, 5-hydroxy-1-naphthalenesulfonic acid, 8-hydroxy-1-naphthalenesulfonic acid, 2-hydroxy-1-naphthalenesulfonic acid, 6-hydroxy-2-naphthalenesulfonic acid, 7-hydroxy-2-naphthalenesulfonic acid, 7-hydroxy-1-naphthalenesulfonic acid, 4,5-dihydroxy-1-naphthalenesulfonic acid, 6,7-dihydroxy-1-naphthalenesulfonic acid, 5-hydroxy-2,7-naphthalenedisulfonic acid, 8-hydroxy-1,6-naphthalenedisulfonic acid, 4-hydroxy-1,6-naphthalenedisulfonic acid, 4-hydroxy-1,5-naphthalenedisulfonic acid, 3-hydroxy-2,7-naphthalenedisulfonic acid, 7-hydroxy-1,3-naphthalenedisulfonic acid, 4,5-dihydroxy-2,7-naphthalenedisulfonic acid, 8-hydroxy-1,3,6-naphthalenetrisulfonic acid, or 7-hydroxy-1,3,6-naphthalenetrisulfonic acid.

19. A method of claim 15 wherein the naphthalenesulfonic compound is 2-naphthol-6,8-disulfonic acid, 1-naphthol-3,6-disulfonic acid, or dipotassium 2-naphthol-6,8-disulfonate.

20. A method of claim 12 wherein the reflowing step comprises heating the coated matte tin to a temperature above the melting point of tin but below the melting point of steel.

21. A method of claim 12 which further comprises adding an acid component to the solution.

22. A method of claim 21 wherein the acid component is hydrochloric acid, sulfuric acid, citric acid, an alkane sulfonic acid, an alkanol sulfonic acid, or ammonium chloride.

23. A method of claim 1 wherein the matte tinplate is rinsed prior to application of the flux solution.

24. A method of claim 12 wherein the matte tin finish is rinsed prior to application of the flux.

* * * * *